US006116048A

United States Patent [19]

Hebert

[11] Patent Number: 6,116,048

[45] Date of Patent: Sep. 12, 2000

[54] DUAL EVAPORATOR FOR INDOOR UNITS AND METHOD THEREFOR

[76] Inventor: Thomas H. Hebert, 1340 Eastwood Dr., Lutz, Fla. 33612

[21] Appl. No.: 09/124,500

[22] Filed: Jul. 29, 1998

Related U.S. Application Data

[63] Continuation-in-part of application No. 08/802,398, Feb. 18, 1997.

[51] Int. Cl.[7] ..... F25B 39/02

[52] U.S. Cl. ..... 62/525; 62/524; 62/526

[58] Field of Search ..... 62/524, 525, 526

[56] References Cited

U.S. PATENT DOCUMENTS

| | | | |
|---|---|---|---|
| 1,891,538 | 12/1932 | Hicks . | |
| 2,124,291 | 7/1938 | Fleisher . | |
| 2,255,585 | 9/1941 | Hubacker . | |
| 2,350,408 | 6/1944 | McGrath . | |
| 2,351,695 | 6/1944 | Newton . | |
| 2,776,543 | 1/1957 | Ellenberger . | |
| 2,801,524 | 8/1957 | Fifield . | |
| 2,938,361 | 5/1960 | McNatt . | |
| 3,264,839 | 8/1966 | Harnish . | |
| 3,537,274 | 11/1970 | Tilney . | |
| 3,902,551 | 9/1975 | Lim et al. . | |
| 4,320,629 | 3/1982 | Nakagawa et al. . | |
| 4,375,753 | 3/1983 | Imasu et al. . | |
| 4,434,843 | 3/1984 | Alford | 62/526 |
| 4,542,786 | 9/1985 | Anders . | |
| 4,574,868 | 3/1986 | Anders . | |
| 4,599,870 | 7/1986 | Hebert . | |
| 4,679,404 | 7/1987 | Alsenz . | |
| 4,873,837 | 10/1989 | Murray . | |
| 4,910,972 | 3/1990 | Jaster . | |
| 5,205,347 | 4/1993 | Hughes . | |
| 5,275,232 | 1/1994 | Adkins et al. . | |
| 5,345,778 | 9/1994 | Roberts . | |
| 5,465,591 | 11/1995 | Cur et al. . | |
| 5,485,732 | 1/1996 | Locatelli . | |
| 5,613,554 | 3/1997 | Bull et al. . | |
| 5,660,056 | 8/1997 | Arai et al. | 62/324.6 |

FOREIGN PATENT DOCUMENTS

| | | |
|---|---|---|
| 559983 | 9/1983 | European Pat. Off. . |
| 2056652 | 3/1981 | United Kingdom . |

*Primary Examiner*—William Doerrler
*Attorney, Agent, or Firm*—Stein, Schifino & Van Der Wall

[57] ABSTRACT

A dual (or multi) sectional evaporator system comprising first and second (or more) evaporator sections capable of cooling the air supply through the evaporator. The first evaporator section is positioned upstream of the second evaporator section (second upstream of the third and so on). However, the warmest refrigerant passes through the first evaporator section and the coldest refrigerant passes through the second evaporator section (or last evaporator section if more than two sections), such that the air supply is precooled prior to reaching the second (or last) evaporator. Providing a two (or more) passes of refrigerant through the dual (or multi) sectional evaporator system increases the superheat temperature out of the first evaporator up to about 25 degrees Fahrenheit, and/or increases the mass flow of refrigerant because of the increased heat exchange efficiency provided by counterflow heat exchange. Moreover, in the preferred embodiment for an A-coil or slant coil, the second evaporator section is positioned over the top of the first evaporator section such that the second evaporator overlays the first evaporator section in order to maximize the use of available space. Also, A-coil or slant coil forms of the present invention are configured such that they include contoured cut-out shaped corner portions wherein the squared corners of the evaporators are substantially eliminated thereby eliminating the dead air flow spaces typically associated with other known evaporators. The elimination of the dead air space allows the system to operate at a lower fan speed as well as allows the system to be constructed and operate within smaller confines.

1 Claim, 13 Drawing Sheets

Dual Source, Dual Coil (or multi) Sectional Evaporator
Conversion of Evcon 2.5 Ton - 12 S.E.E.R. Heat Pump
Model No. DRSH030

| Test Temperature | | 82 Degrees (F.) | | | | 95 Degrees (F.) | | |
|---|---|---|---|---|---|---|---|---|
| | Air | Capacity | E.E.R. | Percent | | Capacity | E.E.R. | Percent |
| Equipment & | Volume | BTUH | BTU/Watt | Latent | | BTUH | BTU/Watt | Latent |
| Conversion | | | | | | | | |
| DRSH030 with Standard Coil Evaporator | 1000 CFM | 322OO | 12.53 | 28.80 % | | 31500 | 11.18 | 23.80 % |
| DRSH030 with Dual Coil Evaporator | 1400 CFM | 44800 | 16.08 | 28.10 % | | 40600 | 13.51 | 24.10 % |
| DRSH030 plus Dual Source at 70 Degree F. Ground Temp. with Dual Coil Evaporator | 1600 CFM | 51417 | 19.09 | 33.90 % | | 50969 | 17.4 | 34.20 % |
| DRSH030 plus Dual Source at 50 Degree F. Ground Temp. with Dual Coil Evaporator | 1600 CFM | 54331 | 21.88 | 36.00 % | | 53882 | 19.4 | 35.10 % |

*FIGURES 10, 10a*

DUAL EVAPORATOR FOR INDOOR UNITS AND METHOD THEREFOR

CROSS-REFERENCE TO RELATED APPLICATIONS

The present invention is a continuation-in-part application of application Ser. No. 08/802,398, filed Feb. 18, 1997, the disclosure of which is hereby incorporated by reference herein.

BACKGROUND OF THE INVENTION

1. Field of the Invention

The present invention relates to a dual (or multi) sectional evaporator system of increased refrigeration capacity for use with any air conditioner, refrigeration or heat pump system. This invention more particularly pertains to an apparatus and method comprising a dual (or multi) sectional evaporator system allowing air to first pass through the warmest sections of an evaporator and then to pass through the coldest sections of the evaporator which provides for 2 (or more) exposures of the air stream to the same refrigerant.

2. Description of the Background Art

Presently there exist many types of devices designed to operate in the thermal transfer cycle. The vapor-compression refrigeration cycle is the pattern cycle for the great majority of commercially available refrigeration systems. This thermal transfer cycle is customarily accomplished by a compressor, condenser, throttling device and evaporator connected in serial fluid communication with one another. The system is charged with refrigerant, which circulates through each of the components. More particularly, the refrigerant of the system circulates through each of the components to remove heat from the evaporator and transfer the heat to the condenser. The compressor compresses the refrigerant from a low-pressure superheated vapor state to a high-pressure superheated vapor state thereby increasing the temperature, enthalpy and pressure of the refrigerant. A superheated vapor is a vapor that has been heated above its boiling point temperature. It then leaves the compressor and enters the condenser as a vapor at some elevated pressure where the refrigerant is condensed as a result of heat transfer to cooling water and/or to ambient air. The refrigerant then flows through the condenser condensing the refrigerant at a substantially constant pressure to a saturated-liquid state. The refrigerant then leaves the condenser as a high-pressure liquid. The pressure of the liquid is decreased as it flows through the expansion valve causing the refrigerant to change to a mixed liquid-vapor state. The remaining liquid, now at low pressure, is vaporized in the evaporator as a result of heat transfer from the refrigerated space. This vapor then enters the compressor to complete the cycle. The ideal cycle and hardware schematic for vapor-compression refrigeration is shown in FIG. 1 as cycle 1-2-3-4-1. More particularly, the process representation in FIG. 1 is represented by a pressure-enthalpy diagram, which illustrates the particular thermodynamic characteristics of a typical refrigerant. The P-h plane is particularly useful in showing amounts of energy transfer as heat. Referring to FIG. 1, saturated vapor at low pressure enters the compressor and undergoes a reversible adiabatic compression, 1-2. Adiabatic refers to any change in which there is no gain or loss of heat. Heat is then rejected at constant pressure in process 2-3, and the working fluid is then evaporated at constant pressure, process 4-1, to complete the cycle. However, the actual refrigeration cycle may deviate from the ideal cycle primarily because of pressure drops associated with fluid flow and heat transfer to or from the surroundings.

It is readily apparent that the evaporator plays an important role in removing the heat from the thermal cycle. Evaporators convert a liquid to a vapor by the addition of latent heat. Latent heat is the amount of heat absorbed or evolved by 1 mole, or a unit mass, of a substance during a change of state such as vaporization at constant temperature and pressure. Most commercially available evaporators have a coil of a tubular body extending within the evaporator for the purpose of providing a heat exchange surface. The coil of each evaporator extends in a serpentine manner from the bottom to the top of the evaporator. Often one of the serpentine rows will cross over another of the serpentine rows in an evaporator such that neither of the rows has more of a heat load. In other words, the amount of heat each row has to absorb is equalized by having rows cross over one another so that the entire load is not on one part of the air flow.

However, these known evaporators have drawbacks. The primary drawback results from the fact that no particular attention has been paid to the variations in temperatures that exist between the inlet of refrigerant to the evaporator and the outlet of the refrigerant from the evaporator.

In an evaporator, there exits distinct different regions, which have varying temperatures for many different reasons. One distinct region is the flash gas loss region, which varies in percentage of evaporator surface area because of the temperature of the sub-cooled (liquid temperature below condenser phase change temperature) liquid entering the evaporator's expansion device. This flash gas loss region has a warmer average temperature than the phase change region of the evaporator. The phase change region of the evaporator is the coldest section of the evaporator and is the region where the liquid refrigerant vaporizes to a gas while absorbing heat from the secondary fluid (air) that comes in thermal contact with it. As long as there is any liquid present, the temperature of this region generally stays constant. Another warmer region exists downstream of the phase change region called the superheat region where the saturated vapor absorbs heat as it warms up. This is a region of the evaporator where no more liquid refrigerant exists and the heat absorption capability is strictly based on the temperature change of the saturated vapor. Even in the phase change region there is a temperature gradient caused by the difference in refrigerant pressures between the beginning of the phase change region and the end of the phase change region (due to a pressure gradient caused by frictional line losses). Finally, with the use of azeotropic (2 or more refrigerants blended together that together exhibit a different set of thermodynamic properties from that of the individual refrigerants) mixtures there is a temperature gradient across the phase change region of the evaporator due to "glide" (a difference caused by the difference in phase change temperatures that results from a change in the percentage of each component of the azeotropic mixture across the evaporator's phase change region).

None of the known embodiments of the evaporator art deals with these known temperature differentials that exist within the scope of the entire evaporator surface.

It is known that the most efficient heat exchange between two fluids, occurs when the two fluids flow counter flow to one another, with the warmest region of the first fluid coming into thermal contact with the warmest region of the second fluid and then the first fluid coming into thermal contact with subsequently colder and colder regions of the second fluid, where the purpose is to cool the first fluid to the coldest possible temperature. No known evaporator art has applied this known principle.

Further some of these known evaporators configurations have additional drawbacks. Due to the particular arrangement of the various components within the thermal transfer cycle, the bulk of the evaporator is often presented as a particular burdensome drawback. For example, a 24" by 24" closet would normally only accommodate a 3.5 ton A-coil system with today's commercially available evaporators not including the present invention.

Moreover, known evaporators typically have rectangular shaped cross sections. Therefore, substantial portions of the ends of known evaporators have insufficient air flow. These ends of these known evaporators have wasted air space resulting in lost evaporator surface area.

In response to these realized inadequacies of earlier configurations of evaporators used within the thermal transfer cycle of air conditioners, refrigeration equipment and heat pumps, and their resulting inefficiencies, it became clear that there is a need for dual (or multi) sectional evaporator designs that would take advantage of the known benefits of fluid to fluid counter flow. The results of the use of these new evaporator designs being greater refrigeration capacity and improved dehumidification, both gained at no additional power consumption for the total refrigeration thermal cycle. The greater capacity being realized from the higher mass flow of refrigerant through the evaporator due to improved heat exchange brought about by the application of counter flow principles and greater dehumidification brought about by cooling the air more effectively below the dew point temperature because of the same improved heat exchange. Moreover, there is a need to significantly reduce the dimensions necessary for placement of an evaporator in a cabinet or closet. In as much as the art consists of various types of evaporator and thermal transfer cycle configurations, it can be appreciated that there is a continuing need for and interest in improvements to evaporators and their configurations, and in this respect, the present invention addresses these needs and interests.

Therefore, an object of this invention is to provide an improvement, which overcomes the aforementioned inadequacies of the prior art devices and provides an improvement, which is a significant contribution to the advancement of the evaporator art.

Another object of this invention is to provide a new and improved dual (or multi) sectional evaporator which has all the advantages and none of the disadvantages of the earlier evaporators in a thermal transfer cycle.

Still another objective of the present invention is improved thermodynamic efficiency.

Yet another objective of the present invention is to provide elements of counter flow principles to all possible variations of types and purposes of evaporators, including those with; minimal sub-cooling, maximum sub-cooling, minimal superheat, maximum superheat, low pressure gradients, high pressure gradients, low "glide" temperature spreads, high "glide" temperature spreads, as well as for; flat coils, slant coils or "A" coils, and for; down-flow or up-flow design. The purpose for each design being to put the warmest part(s) of the evaporator upstream in the air flow from the coldest part(s) of the evaporator.

Still a further objective of the present invention is to provide increased refrigeration capacity.

Yet a further objective is to allow for increased latent heat removal and, therefore, increased dehumidification.

An additional objective is to provide an evaporator that is highly reliable in use.

Another objective is to provide an evaporation system having an increased Energy Efficient Ration (EER) as a result of a decrease in wattage input and an increase in refrigeration capacity.

Even yet another objective is to provide dual (or multi) sectional evaporators designed to provide for vaporizing a refrigerant passing through a thermal transfer cycle, where a dual (or multi) sectional evaporator is to be placed in an air stream generated by an air supply and the dual (or multi) sectional evaporator comprising in combination 2 or more sections of the evaporator, positioned in the airstream so that the warmest section(s) of the evaporator is (are) upstream of the coldest section(s) of the evaporator so that the air hitting the upstream section(s) of the evaporator is (are) pre-cooled before hitting the colder down stream section(s) of the evaporator.

Another objective of the present invention is to provide a method for enhancing latent heat removal in a thermal transfer cycle by cooling the air to temperatures even lower than standard evaporators do so that the air is substantially below the dew point temperature of the air. By increasing the temperature difference below the dew point temperature, more humidity is removed and the latent capacity percentage of the total heat removal is increased.

Yet another objective of the present invention is to provide a method for increasing the superheat capacity of a refrigerant in a thermal transfer cycle. This increases the total change in enthalpy of the refrigerant per unit mass flow and thereby increases overall capacity. This is accomplished by putting the warmer superheat region of the evaporator upstream in the air supply from the colder region(s) thereby supplying more heat to this superheat region.

Even yet another objective of the present invention is to provide an apparatus and method that will increase overall refrigerant mass flow thereby increasing refrigeration capacity while doing so in a more efficient manner.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment, in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus that satisfies the need for increased refrigeration capacity, increased dehumidification and maximum utilization of available space. For the purpose of summarizing the invention, the dual (or multi) sectional evaporator system for vaporizing a refrigerant passing through a thermal transfer cycle comprises first and second evaporator sections (or more) in serial fluid communication with one another. The evaporator sections themselves may be any of a variety such as flat, slant, or A-coil evaporators capable of being utilized in a dual (or multi) sectional evaporator system. The present invention further comprises positioning the dual evaporator system in an air stream wherein a first evaporator section is positioned in the air stream upstream of a second evaporator section (or more), which is (are) also positioned in the same air stream, such that the air supply is precooled before reaching the second (and/or more) evaporator section(s).

Simply, the coldest refrigerant passing through the thermal transfer cycle flows through the second (or more) or downstream evaporator section while the warmest refrigerant flows through the first or upstream evaporator section. The configuration of the present invention, providing a fist pass of air past the warmer evaporator section(s) precools the air supply before the air supply hits the colder downstream evaporator section(s) resulting in increased superheat temperatures and/or increased refrigerant mass flow out of the first evaporator section and, therefore, increased enthalpy and capacity. The increase in superheating of the refrigerants with the present invention may be up to 15 degrees Fahrenheit above standard superheat temperatures. Therefore, for every degree of increased superheating, there is a resulting increase in cooling capacity of the system. Also refrigerant mass flow will be increased, which contributes even more to increasing the cooling capacity of the system.

Moreover, the present invention may be configured such that wasted air space in the evaporators as a result of insufficient air flow across the evaporators is virtually eliminated. This problem may be solved by removing the squared corners of the evaporators; thereby creating contoured cut-out shaped corner portions, which decreases the area of lost refrigeration. Thus, the evaporators become more efficient and require a lower air flow. Because of the reduction in the fan speed necessary for adequate air flow, the efficiency of the refrigeration system increases as a result of the decrease in the input wattage to the fan. Thus, the Energy Efficiency Ratio (EER) increases because of the reduction in the necessary fan speed as well as the increased mass flow and/or increased superheat of the refrigerant because of the secondary (or more) contact(s) of the refrigerant with the same air supply through the dual (or multi) sectional evaporator system of the present invention. Moreover, utilizing the evaporators with contoured cut-out shaped corner portions decreases the space the evaporator will take up.

Furthermore, each of the evaporator sections of the present invention may have their inner coil configured in a particular manner as a result of the contoured cut-out shaped corner portions. Basically, evaporators are comprised of a plurality of serpentine rows extending from the bottom to the top of the evaporator. Each row of the coil within each evaporator should be of equal length. Simply, where the evaporator of the present invention comprises of contoured cut-out shaped corner portions, a serpentine row extends from the bottom of the evaporator on one side of the evaporator and then crosses over to the opposite side of the evaporator in order to reach the top of the evaporator. Typically, however, the center row of the coil of the present invention may extend upward without crossing over because the center of the evaporator is the average length of the evaporator. Therefore, a row of the coil may cross over another adjacent row in order to equal out its length because it may be able to extend further because the evaporator may be longer on the opposite side of the evaporator. On the other hand, where a row is particularly long, it may cross over to an opposite side, which is respectively shorter. Therefore, because of the decreased space and the configuration of the coils in adapting to the decrease in space, the fan speed can be reduced while maintaining and even increasing superheating and/or mass flow.

An important feature of the present invention is that the wasted air surface, because of insufficient air flow to the squared corner ends of the evaporators, has been reduced. Therefore, it can be readily seen that the present invention provides a means to decrease the area of lost refrigeration as well as decrease the space the evaporator takes up. Thus, an evaporator such as the present invention that is capable of increasing the latent heat removal and total capacity of a system, but which minimizes the space necessary for such a device, would be greatly appreciated.

Another important feature of the present invention is that the warmest refrigerant passes through a first upstream evaporator section thereby pre-cooling the air supply. This pre-cooling results in increased mass flow and/or increased superheat temperatures and, therefore, increased capacity. The pre-cooling also results in enhanced latent heat removal from the air supply. Therefore, it can be seen that the present invention would be greatly appreciated even more so.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which:

FIG. 10 is a comparison sheet for capacities and EERs determined under certified conditions that compare actual data for air conditioning/heat pump equipment with and without the dual (or multi) sectional evaporator.

DETAILED DESCRIPTION OF THE PREFERRED EMBODIMENT

Figure 7:
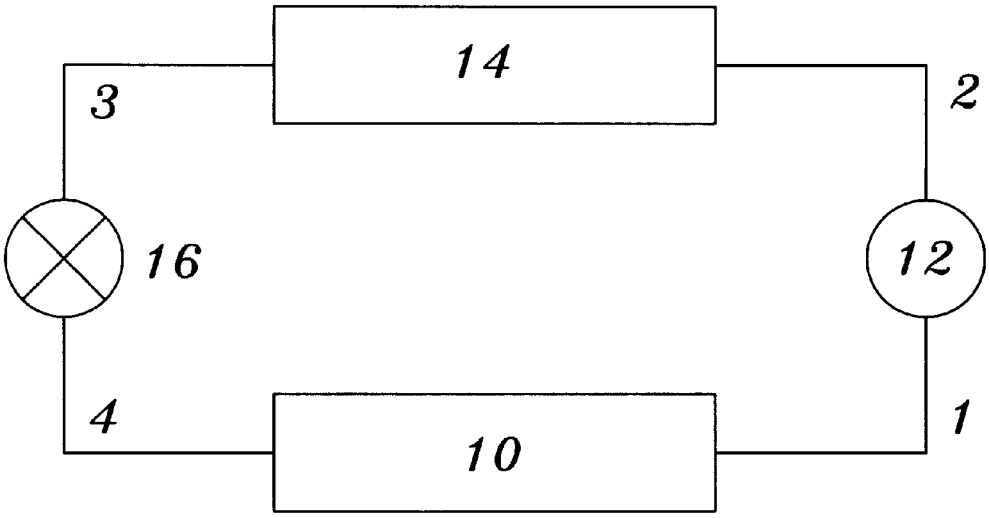
FIG. 7 is a hardware schematic of the vapor compression refrigeration cycle showing the location of a standard evaporator.
Figure 7A:
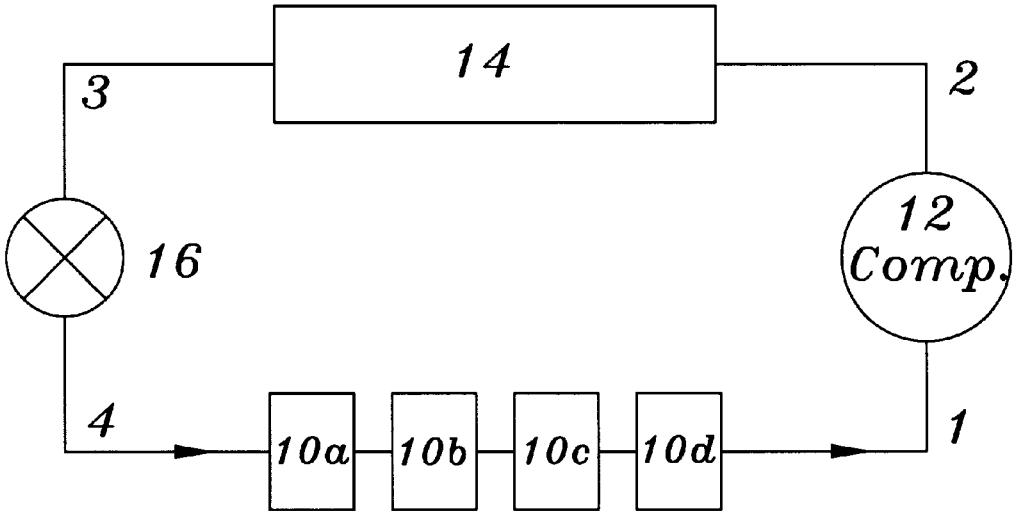
FIG. 7*a* is a hardware schematic of the vapor compression refrigeration cycle showing the location of a dual (or multi) sectional evaporator and identifying each of the possible sections of the evaporator and the possible relationships in regard to temperature.

With reference to the drawings, and in particular to FIGS. 3, 3*a*, 3*b*, 4*a*, 4*c*, 3*c*, 5, 5*a*, 5*b*, 5*c*, 6, 6*a*, 6*b* and 6*c* thereof, a new and improved evaporation system embodying the principles and concepts of the present invention and generally designated by the reference number (10) will be described. The dual (or multi) sectional evaporator system (10) of the present invention comprises a first evaporator section (20) located first or upstream in an air stream (66) and a second evaporator section (30) located downstream in the air stream from the first evaporator section and, if applicable, additional evaporator sections (40, 50) located even further downstream in the air stream of the second evaporator. The dual (or multi) sectional evaporator sections are to be connected in serial communication as shown in FIG. 7*a*. The present invention may have various configurations comprising of a variety of different evaporator types, to include flat coil, A-coil, or slant coil dual (or multi) sectional evaporators and the like as partially illustrated by FIGS. 3, 3*a*, 3*b*, 3*c*, 4*a*, 4*c*, 5, 5*a*, 5*b*, 5*c*, 6, 6*a*, 6*b* and 6*c*. FIGS. 3, 3*a*, 3*b* and 3*c* illustrate generally the preferred embodiment of the invention where the warmest sections of the evaporator are located in the upstream area of the air stream with subsequently colder sections of the evaporator located further and further downstream in the air stream.

Figure 4:
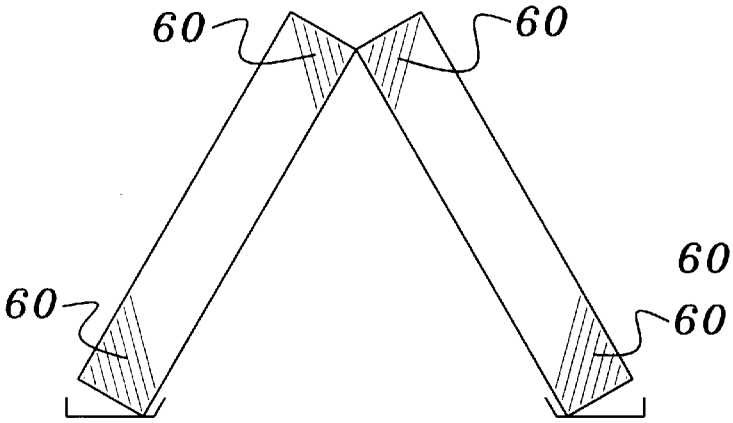
FIG. 4 (Prior Art)
FIG. 4 is an illustration of prior art A-coil evaporators.
Figure 4B:
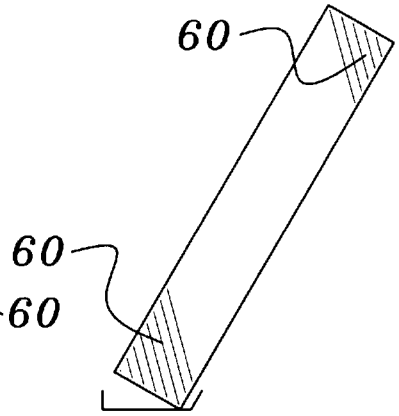
FIG. 4b (Prior Art)
FIG. 4*b* is an illustration of prior art slant coil evaporator.
Figure 4A:
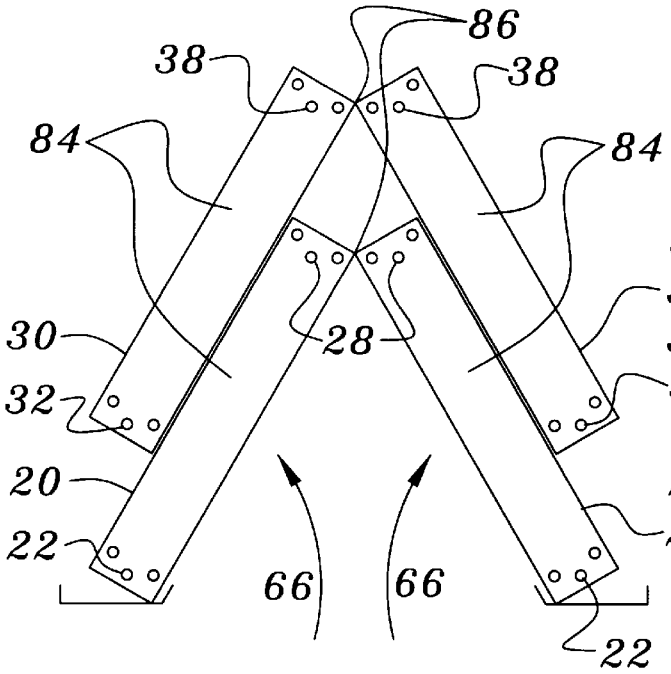
FIG. 4*a* is an illustration of one embodiment of the A-coil form of the present invention.
Figure 4C:
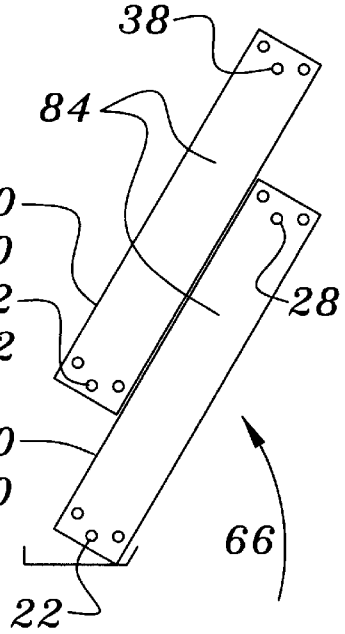
FIG. 4*c* is an illustration of one embodiment of the slant coil form of the present invention.

FIGS. 4 and 4*b* illustrate the prior art A-coil and slant coil evaporators known in the industry where in the squared corners of the evaporators have dead air flow space (60). As shown in FIGS. 4*a* and 4*c*, the first and second evaporator sections of one embodiment of a 2 section dual (or multi) sectional evaporator (20) and (30) each have side view cross sections (84) which are best used for illustrating the internal configurations of evaporators.

Figure 3:
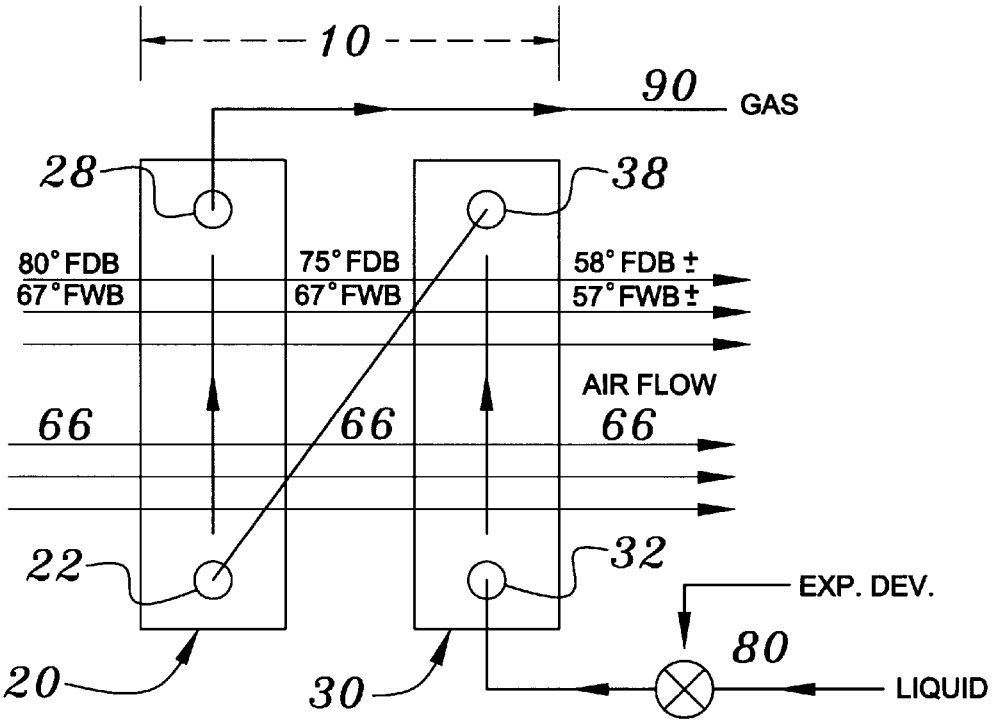
FIG. 3 is an illustration of both the refrigerant and air flow in a 2 section dual (or multi) sectional evaporator system of the present invention for use where there is good subcooling.
Figure 3A:
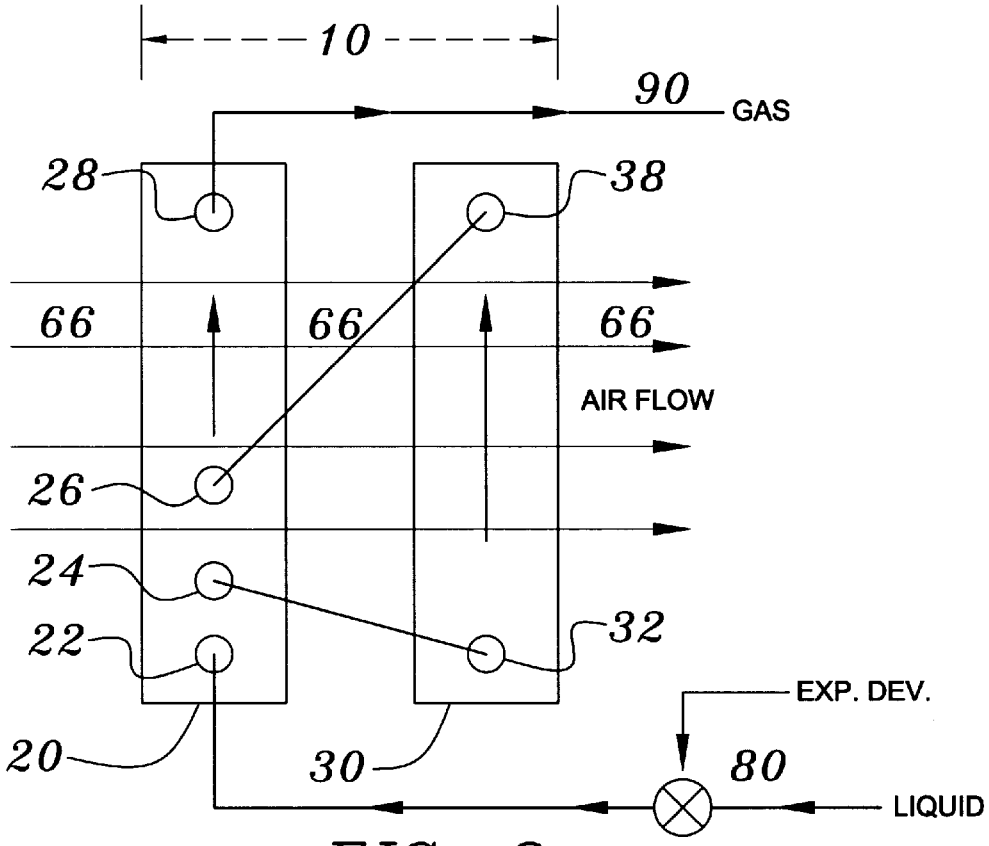
FIG. 3*a* is an illustration of both the refrigerant and air flow in a 2 section dual (or multi) sectional evaporator system of the present invention for use where there is little or no subcooling.
Figure 3B:
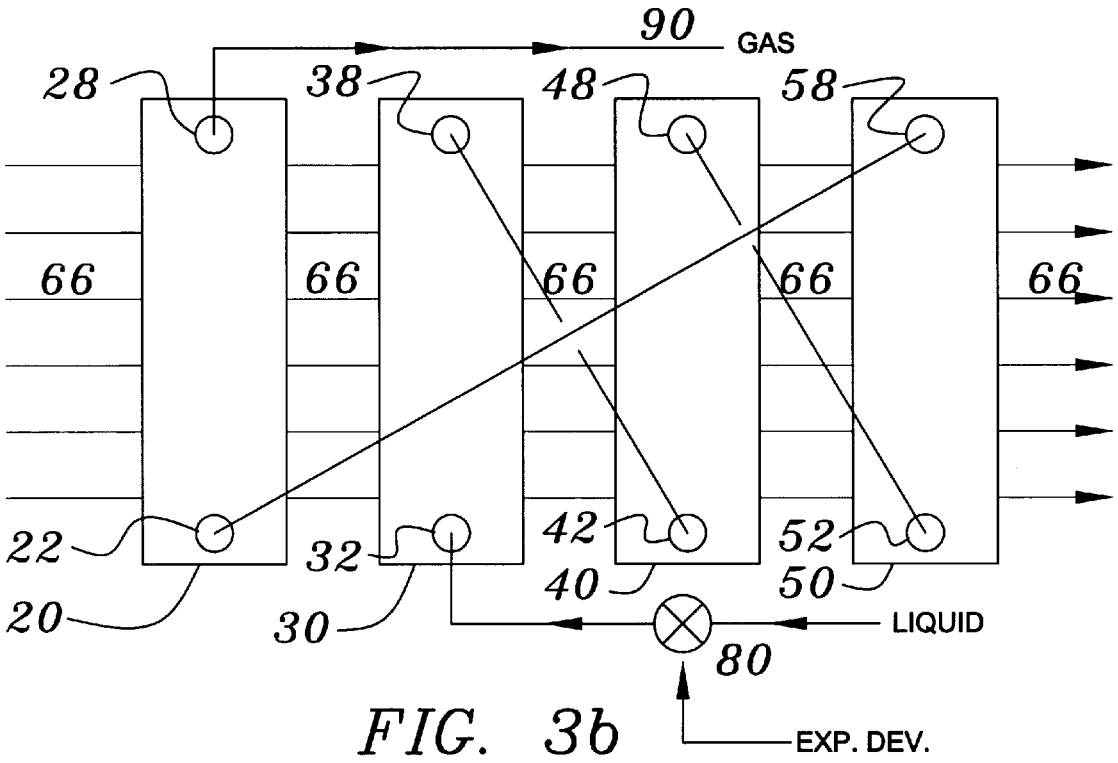
FIG. 3*b* is an illustration of both the refrigerant and air flow of the dual (or multi) sectional evaporator that would account for all possible differences in evaporator section temperatures including those due to pressure gradient for a single component refrigerant.

FIGS. 4*a* (and 4*c*) illustrates the preferred arrangement of the present invention of a 2 section dual (or multi) sectional evaporator comprising a first A-coil (or slant coil) evaporator section (20) overlaying a second A-coil (or slant coil) evaporator (30) such that a midpoint (86) of the first A-coil (or slant coil) is adjacent to a midpoint (86) of the second A-coil (or slant coil) evaporator (30). On an A-coil the midpoint (86) is centered between each half for forming the A-shape of each evaporator combined to form the 2 section dual (or multi) sectional evaporator system (10). Each side of an A-coil (one side of a slant coil) 2 section dual (or multi) sectional evaporator system (10) of the present invention singlely represents the configuration as illustrated in FIGS. 3 and 3*a*.

FIGS. 5, 5*a*, 6 and 6*a* illustrate some of the possible A-coil configurations that show the method and embodiment required for space savings.

FIGS. 5*b*, 5*c*, 6*b* and 6*c* illustrate some of the possible slant coil configurations that show the method and embodiment required for space savings.

FIGS. 5, 5*b*, 6 and 6*b* illustrate the preferred embodiment for A-coils and slant coils for use where the air flow is upward and the dual (or multi) sectional evaporator is comprised of just a first and a second section.

FIGS. 5*a*, 5*c*, 6*a*, and 6*c* illustrate the preferred embodiment for A-coils and slant coils for use where the air flow is downward and the dual (or multi) sectional evaporator is comprised of just a first and a second section.

The dual (or multi) sectional evaporator is to be connected in serial fluid communication for the refrigerant fluid as shown in FIG. 7*a* with the warmest sections of the evaporator placed in the farthest upstream section of the airstream and the coldest sections of the evaporator placed in the farthest downstream section of the airstream as illustrated in all the previously mentioned figures. The thermal transfer cycle (8) of the present invention comprises all the different thermal transfer sections of the evaporator; flash gas loss region (10*a*), highest pressure phase change region (10*b*) (or warmest phase change region due to the "glide" of an azeotropic refrigerant mixture (10*b* or 10*c*), lowest pressure phase change (coldest) region (10*c*) (or coldest phase change region due to the "glide" of an azeotropic refrigerant mixture (10*b* or 10*c*), and the superheat region (10*d*); further comprising a compressor (12), a condenser (14) and an expansion device (preferably a thermostatic expansion valve (16) connected in serial communication with one another. The thermal transfer cycle (8) is charged with refrigerant, which circulates through each of the components, including the individual dual (or multi) sectional evaporator sections of the present invention.

Figure 3C:
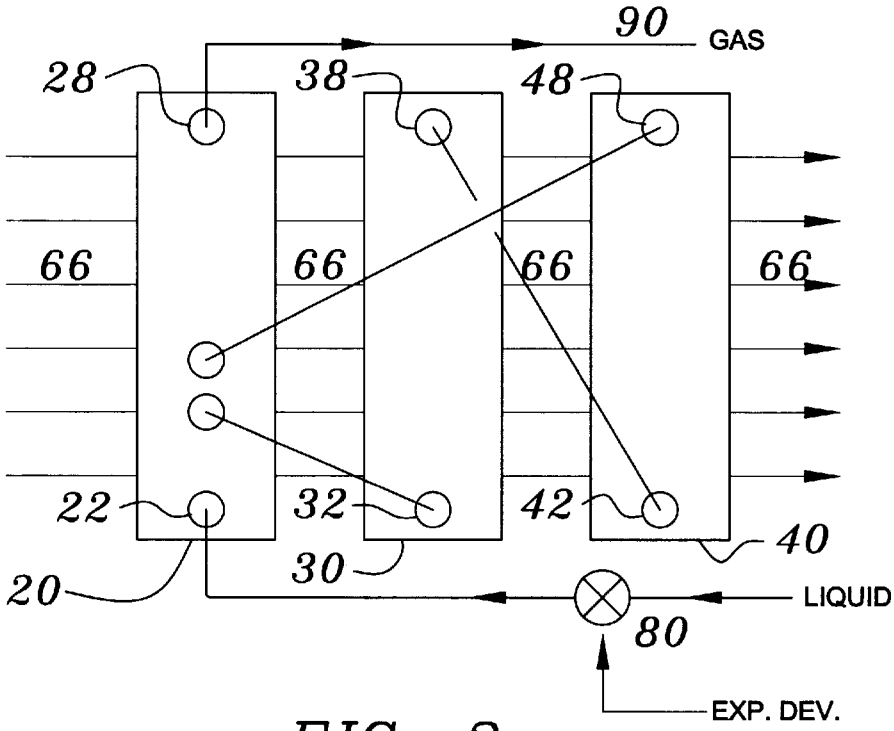
FIG. 3*c* is an illustration of both the refrigerant and air flow of the dual (or multi) sectional evaporator that would account for all possible differences in evaporator section temperatures including those due to "glide" for an azeotropic refrigerant mixture.

The first sections (warmest) of the dual (or multi) sectional evaporator (20) (10*a* and/or 10*d*) should be positioned in the airstream upstream of the second (and subsequent sections, if applicable) sections(s) (colder then coldest) of the dual (or multi) sectional evaporator (10*b* or 10*c*).

Where there is little or no subcooling (FIGS. 3*a*, 6, 6*a*, 6*b* & 6*c*), in a 2 section dual (or multi) sectional evaporator, the refrigerant flows from the expansion device (80) to the bottom of the first evaporator section (22) then proceeds part way up that first evaporator until the flash gas loss process has been completed (24) then back to the bottom at the second evaporator section (32) where the refrigerant then flows upward on that second evaporator section to the top of that same evaporator (34). The refrigerant then flows from the top of the second evaporator section (34) back to a position just above where the refrigerant had finished the flash gas loss process (and subsequently flowed to the second evaporator section) (26). From there the refrigerant flows upward to the top of the first evaporator (28) and then the refrigerant flows out of the evaporator and back to the compressor (90).

Where there is good subcooling (FIGS. 3, 5, 5*a*, 5*b* and 5*c*) in a 2 section dual (or multi) sectional evaporator, the refrigerant flows from the expansion device (80) to the bottom of the second evaporator section (32) then proceeds all the way up that second evaporator section to the top of that second evaporator section (38) then back down to the bottom of the first evaporator section (22) where the refrigerant then flows upward in that first evaporator section to the top of that first evaporator section (28), and then out of the evaporator and back to the compressor (90).

Where all temperature variations are to be considered (FIGS. 3*b* or 3*c*) in a multi-section dual (or multi) sectional evaporator, the refrigerant flows from the expansion device (80) to the bottom of the second (or first, FIG. 3*c*) section of the evaporator (32) (22, FIG. 3*c*) where the refrigerant then passes to the top of that second (or part way up first, FIG. 3*c*) evaporator section (38) (24, FIG. 3*c*) then on to the bottom of the third (or second, FIG. 3*c*) evaporator section (42) (32, FIG. 3*c*), from there to the top of that third (or second, FIG. 3*c*) evaporator section (48) (38, FIG. 3*c*), then the refrigerant flows to the bottom of the fourth (or third, FIG. 3*c*) evaporator section (52) (42, FIG. 3*c*) and then to the top of that final fourth(or third, FIG. 3*c*) evaporator section (58) (48, FIG. 3*c*). The refrigerant then passes to the bottom (or midpoint, FIG. 3*c*) of the first evaporator section (22) (26, FIG. 3*c*), then the refrigerant flows to the top of that first evaporator section (28) and then passes out of the evaporator and back to the compressor (90). Even more sections could be added for a more complete counterflow of temperatures.

Figure 4D:
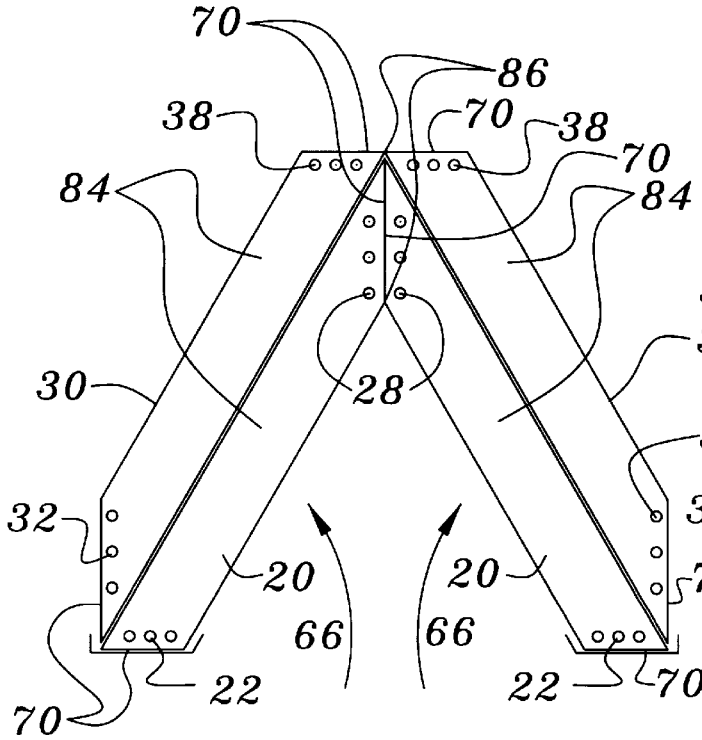
FIG. 4*d* is an illustration of one embodiment of the A-coil form of the present invention showing possible contoured cut-outs for space savings.
Figure 4E:
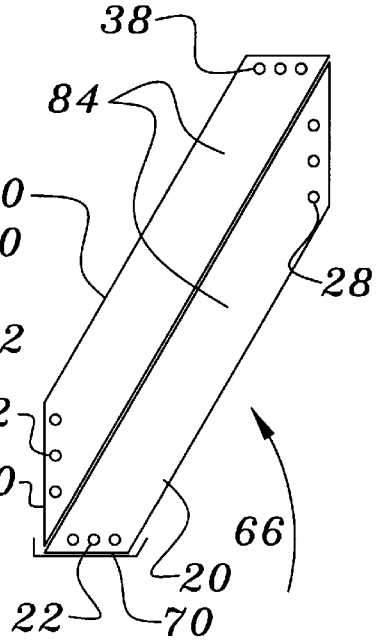
FIG. 4*e* is an illustration of one embodiment of the slant-coil form of the present invention showing possible contoured cut-outs for space savings.
Figure 5:
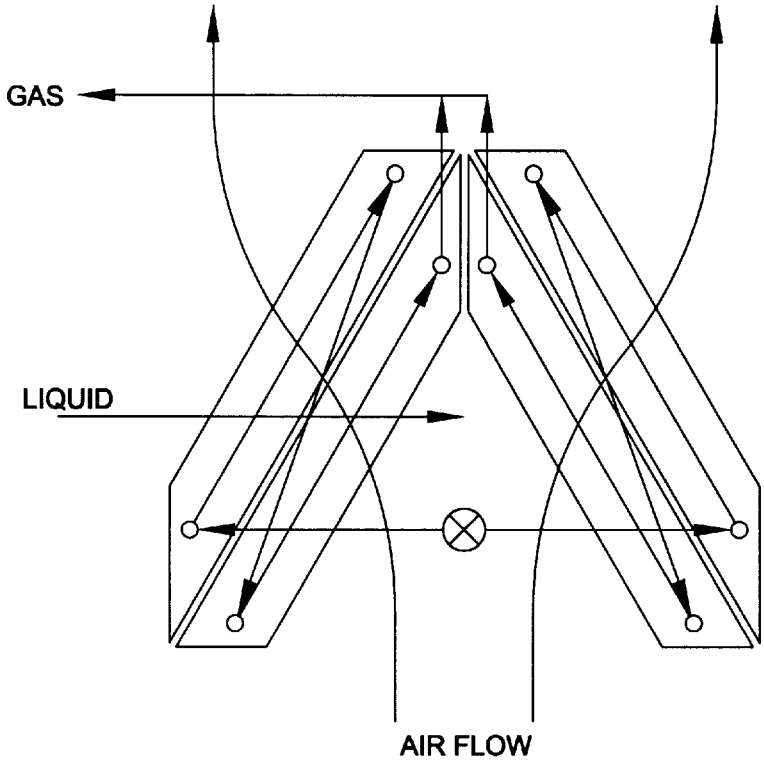
FIG. 5 is an illustration of the preferred embodiment of the A-coil (form of the dual (or multi) sectional evaporator for use where there is good subcooling, an upflow air stream and showing cut out shaped corner portions for space savings.
Figure 5A:
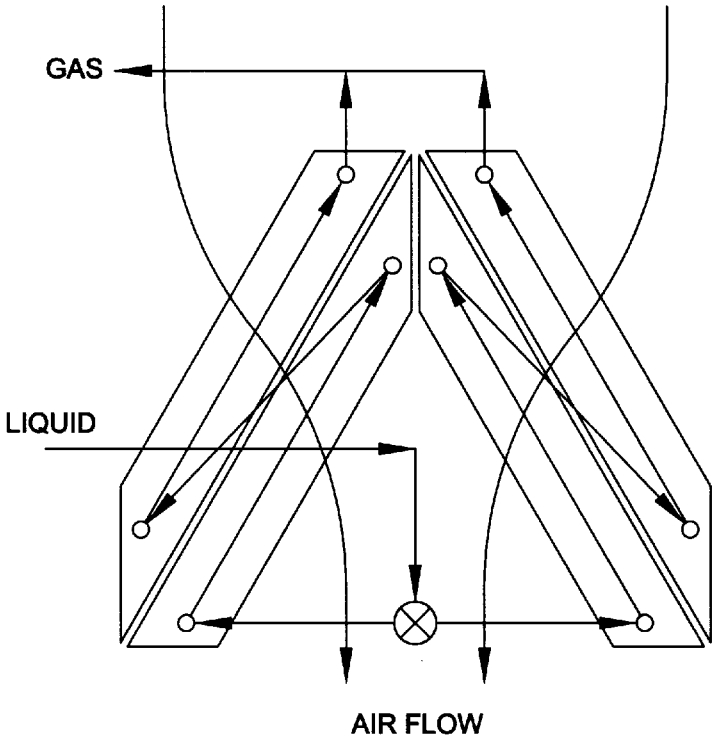
FIG. 5*a* is an illustration of the preferred embodiment of the A-coil form of the dual (or multi) sectional evaporator for use where there is good subcooling, a downflow air stream and showing cut out shaped corners for space savings.
Figure 6:
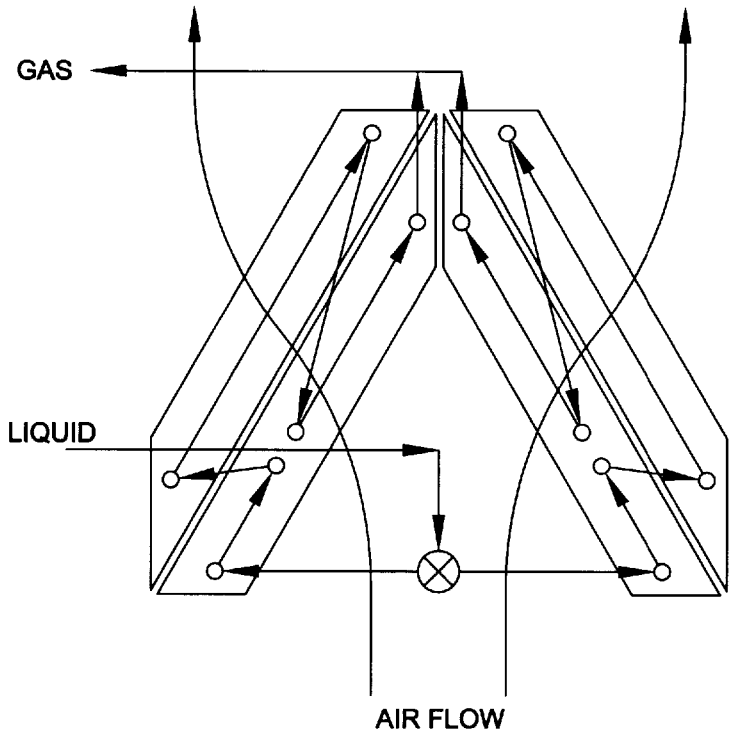
FIG. 6 is an illustration of the preferred embodiment of the A-coil form of the dual (or multi) sectional evaporator where there is little or no subcooling, upflow air flow and showing cut out shaped corner sections for space savings.
Figure 6A:
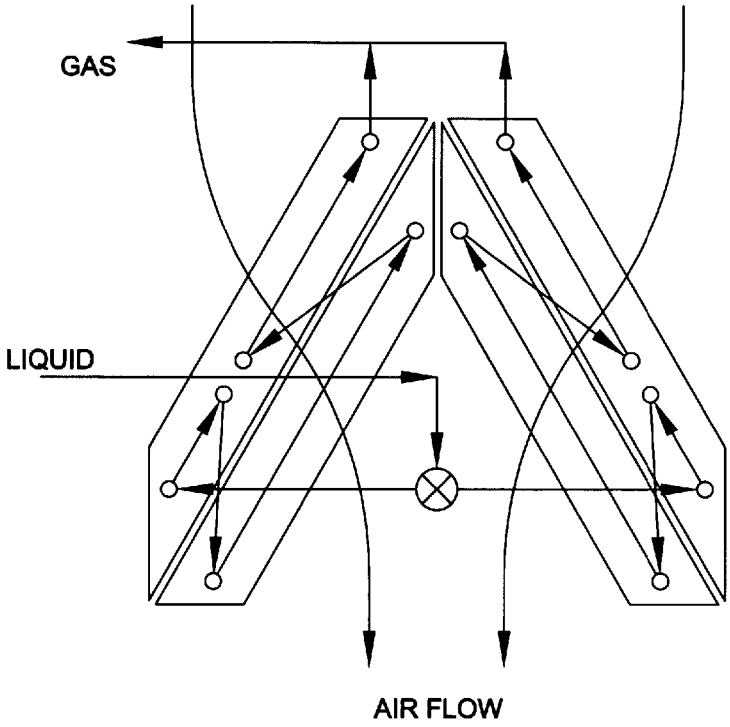
FIG. 6*a* is an illustration of the preferred embodiment of the A-coil form of the dual (or multi) sectional evaporator where there is little or no subcooling, downflow air flow and showing cut out shaped corner sections for space savings.
Figure 5B:
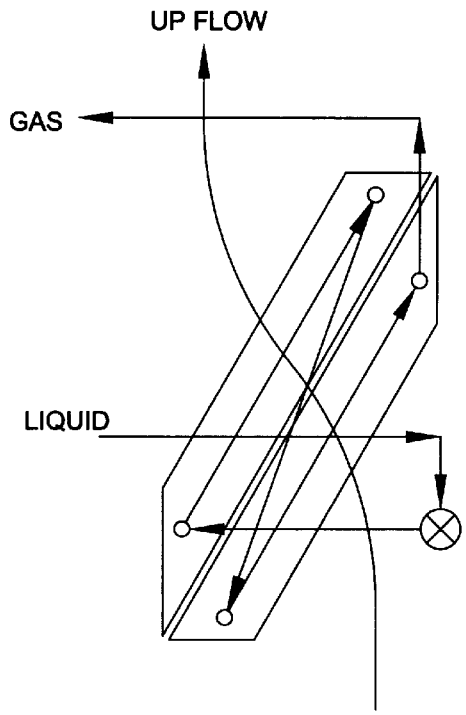
FIG. 5*b* is an illustration of the preferred embodiment of the slant coil form of the dual (or multi) sectional evaporator for use where there is good subcooling, upflow air and showing cut out shaped corner sections for space savings.
Figure 5C:
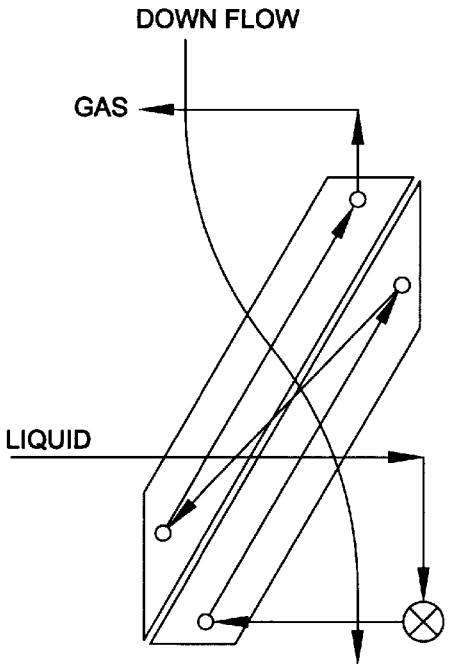
FIG. 5*c* is an illustration of the preferred embodiment of the slant coil form of the dual (or multi) sectional evaporator where there is good subcooling, downflow air flow and showing cut out shaped corner sections for space savings.
Figure 6B:
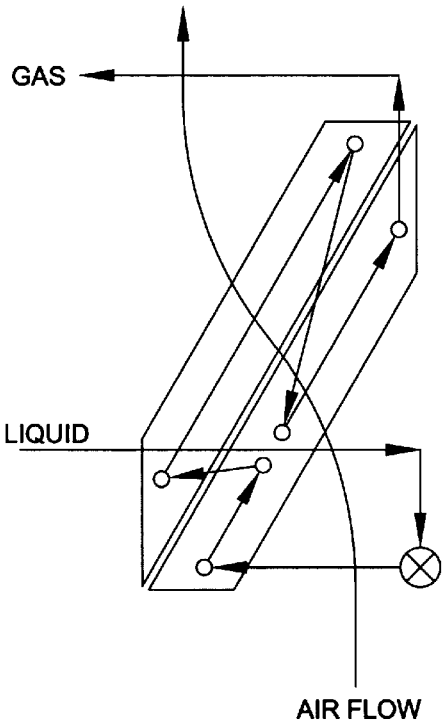
FIG. 6*b* is an illustration of the preferred embodiment of the slant coil form of the dual (or multi) sectional evaporator where there is little or no subcooling, upflow air flow and showing cut out shaped corner sections for space savings.
Figure 6C:
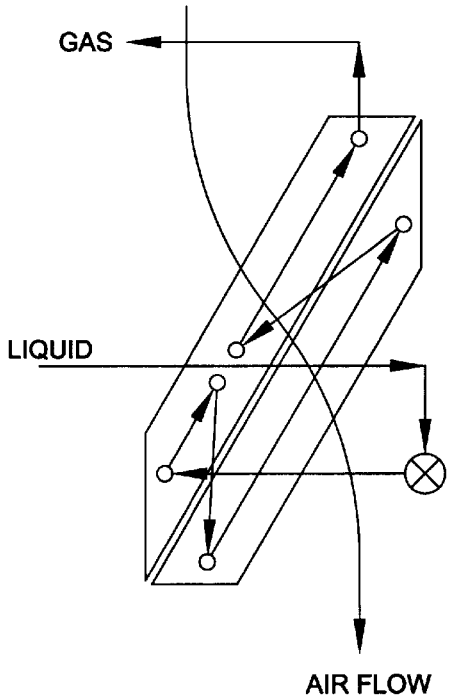
FIG. 6*c* is an illustration of the preferred embodiment of the slant coil form of the dual (or multi) sectional evaporator where there is little or no subcooling, downflow air flow and showing cut out shaped corner sections for space savings.

The inventor has further discovered, that for A-coil and slant coil evaporators (FIGS. 4*d* & 4*e*) of the 2 section dual (or multi) sectional evaporator system, the evaporators can have a plurality of contoured cut out shaped corner portions (70) which substantially eliminate dead air flow space (60) in the corners and reduces the size of the evaporator width (82) substantially as well.

As generally described earlier, the first and second sections of a 2 section dual (or multi) sectional evaporator system are positioned in the air stream (66) in such a way that the first section of evaporator (the warmest section) is upstream in the air supply flow direction from the second section (coldest section). This precools the air supply with the warmest section of the evaporator (20) before the air comes in thermal contact with the coldest section(s) of the evaporator (30). Precooling the air supply (66) brings the air closer to the dew point temperature before the air hits the second evaporator (the coldest section) (30) (or 40, 50) which in turn will increase the latent heat removal. This allows for a lower rate of air flow per ton of refrigeration capacity while accomplishing full evaporation. Further, because of the more efficient heat exchange allowed by the element of fluid to fluid counterflow (temperature counterflow) a higher mass flow of refrigerant can be maintained, thereby increasing refrigeration capacity per unit air flow. FIGS. 3 and 3*a* illustrate the positioning of the respective evaporator sections (20) (30), within the airstream (66).

As seen in FIGS. 4*d*, 4*e*, 5, 5*a*, 5*b*, 5*c*, 6, 6*a*, 6*b* and 6*c* the cross sections (84) of the a-coil and slant coil 2 section dual (or multi) sectional evaporator system (20) and (30) having a plurality of contoured cut out shaped corner portions (70) not only reduce the size of the evaporators, allowing the evaporator to be contained in a smaller area, but the elimination of dead air flow space (60) decreases the area of lost refrigeration heat exchange and also permits lower fan speeds as does precooling the air supply. Thus, eliminating the areas of lost refrigeration, the overall power consumption of the system is reduced.

Figure 8:
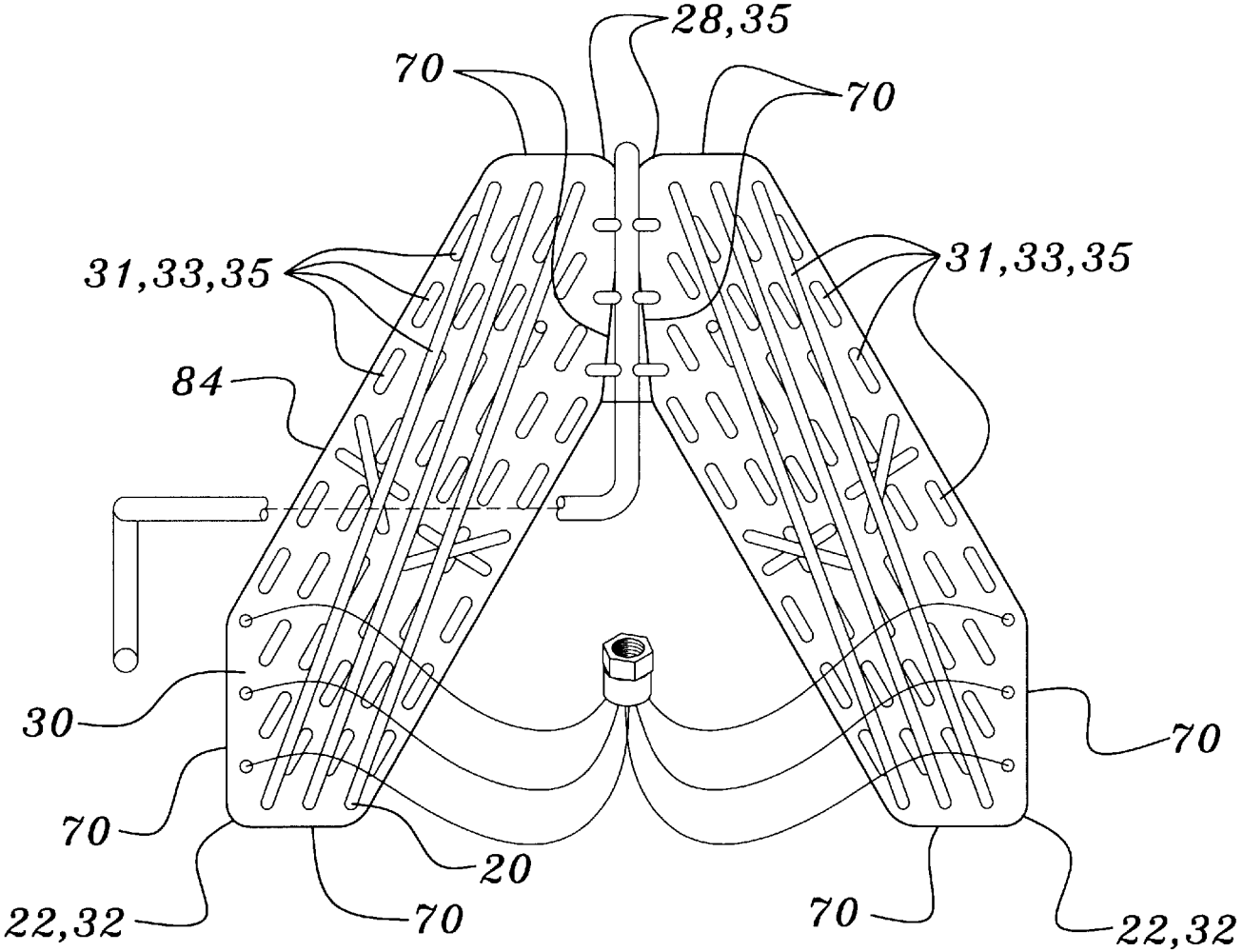
FIG. 8 is a side view cross section of one embodiment of an A-coil evaporator of the present invention.
Figure 9:
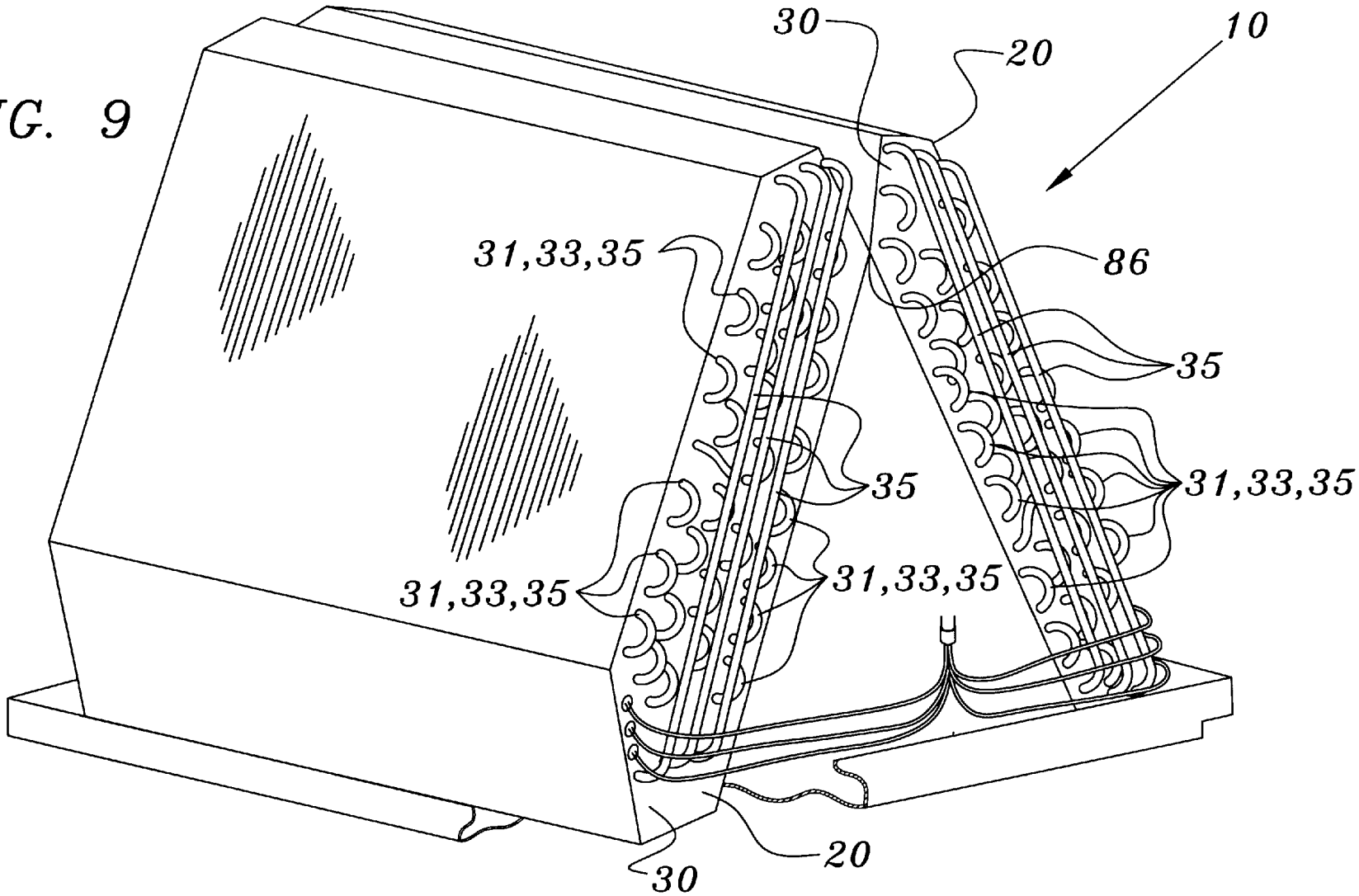
FIG. 9 illustrates a perspective view of one embodiment of an A-coil evaporator of the present invention.

For an A-coil representation of a 2 section dual (or multi) sectional evaporator configured for upflow air flow and good subcooling, as best shown in FIGS. 8 and 9 together, the evaporators (20) and (30) have a coil (31) for providing a vaporization surface (33). The coil (31) forms a plurality of serpentine rows (37) extending from the bottoms (22) and (32) to the tops (28) and (38) of the evaporators (20) and (30) respectively. Each of the serpentine rows (37) of the coil (31) extending from the bottoms (22) and (32) to the tops (28) and (38) should be of equal length. As shown in FIGS. 8 and 9, the coil (31) winds it way from the bottoms (22) and (32) of each evaporator (20) and (30) in a serpentine manner, forming serpentine rows (37) which may over lap one another if necessary to equal out their lengths. The length of a particular row (37) is averaged against the other rows (37) of a particular side of an A-coil by matching a shorter portion of a row (37) with a longer portion. For example, as shown in FIG. 8, the outer short portion of a row (37) at the bottom (22) of the A-coil evaporator (20) crosses over an adjacent row (37) to a longer portion of the row (37) at the center of the left side of the dual evaporator system (10). The shorter portion of row (37) crosses over to the upper longer half such that the overall length is increased and is, therefore, equal in length with the other rows (37) on evaporator (20) and evaporator (30) of the dual (or multi) sectional evaporator system (10).

The use of the dual (or multi) sectional evaporator system (10) as described above constitutes an inventive method of the present invention in addition to the dual (or multi) sectional evaporator system (10) itself. In practicing the method for enhancing latent heat removal in a thermal transfer cycle (8) by increasing the superheat capacity and/or mass flow of a refrigerant passing there through with the dual (or multi) sectional evaporator system (10) as described above, the steps for a 2 section dual (or multi) sectional evaporator include subjecting an air stream (66) to the first evaporator section (20) and a second evaporator section (30). The first and second evaporator sections (20) and (30) are positioned in the air stream (66) such that the first evaporator section is positioned upstream of said second evaporator section (30) and the second (30) evaporator section is positioned downstream of the first evaporator section (20).

The method then includes the step of providing two (or more) contacts between the air supply and the refrigerant in the evaporator where by the warmest air first comes into contact with the refrigerant when it is at its warmest in the evaporator portion of the thermal transfer cycle, and then comes back into contact with the refrigerant when it is at it's coldest in the evaporator portion of the thermal transfer cycle. In other words, the method provides for precooling the air stream with one thermal transfer contact with the warmest section(s) of the refrigerant in the evaporator section of the thermal transfer cycle before the air stream then comes in contact with the coldest section(s) of the refrigerant in the evaporator section of the thermal transfer cycle. Alternatively, the first evaporator section may be a first A-coil (or slant coil) evaporator section and the second evaporator section may be a second A-coil (or slant coil) evaporator section as described above.

Also, the method may further comprise the step of eliminating dead air space (60) in the first and second evaporator sections (20) and (30) by removing the corners of the evaporators to thereby form contoured cut-out shaped corner portions (70) thereby reducing the necessary flow of air of the air stream (66) and also reducing the size of the evaporator.

The method of the present invention may also further comprise of the step of controlling the rate of air flow of the air stream through the first and second evaporator sections (20) and (30). Also, the present invention includes the method wherein the thermal transfer cycle (8) comprises a compressor (12), condenser (14) and an expansion valve (16) connected in serial fluid communication with one another.

The advantages of the present invention are as explained below with the following calculations. For example, for a single evaporator, subcooling to 70 degrees Fahrenheit and 12 degrees superheat, utilizing a published Pressure Enthalpy diagram for Refrigerant 22, h (enthalpy) at a 70 degree liquid temperature=30.387, h at the saturated vapor line is =108 and h at 12 degrees Fahrenheit superheat is =111. Therefore, the refrigerant effect for the single evaporator is calculated as follows:

$$\begin{aligned}\text{Refrigerant effect} &= m \times [(108 - 30.387) + (111 - 108)] \\ &= [80.613 + 3] \times m. \\ &= [80.613\ \text{Btu/lb. mass of refrigerant circulated}] \times \text{mass of refrig. circulated}\end{aligned}$$

For a dual evaporator, subcooling to 70 degrees F. 25 degrees F. Superheat, a phase change temperature of 55 degrees F. (higher phase damage temperature results in increased mass flow of approximately 25% which is a result of counterflow efficiency), and where h at a 70 degree liquid temperature=30.387, h at the saturated vapor line=109, and h at 25 degrees superheat is =114, the refrigerant effect may be calculated as follows:

$$\begin{aligned}\text{Refrigeration effect} &= 1.25 \times m \times [(109 - 30.387) + (114 - 109)] \\ &= 1.25 \times m \times [83.613] \\ &= 83.613\ \text{Btu/lb. Mass of refrigerant circulated} \times 1.25 \times \text{mass of refrigerant circulated at 45 degrees evaporator temperature}\end{aligned}$$

An overall increase of [(1.25×83.613)−80.613]÷80.613×100=29.7%

Thus, an increase of 29.7% results with the dual evaporator system (10) because of increased mass flow and the secondary pass of refrigerant through a second evaporator. Moreover, if the evaporator temperature remained the same as the single evaporator having an evaporator phase change temperature of 45 degrees F., then the refrigeration effect would be as follows:

$$\begin{aligned}\text{Refrigeration effect} &= (108 - 30.387) + (113 - 108) \\ &= 77.613 + 5 \\ &= 82.613\ \text{Btu/lb. mass}\end{aligned}$$

An increase of 2.48% [(82.613−80.613)−80.613×100=2.48%] results from a dual evaporator system at a 45 degrees F. evaporator temperature. Therefore, with a dual evaporator having either a 45 degree F., or a 55 degree F. phase change evaporation temperature, there would be a significant increase in refrigeration capacity.

This increase in refrigeration capacity can be coupled with a reduction in air volume through the evaporator, which results in a lower fan penalty. Therefore, the EER of the system is increased. For example, for a 30,000 net Btuh capacity system utilizing 1400 cfm of air flow, the capacity without the fan penalty of 365 watts per 1000 cfm may be calculated as follows:

Capacity=30,000+1.4×365×3.413

(w/o fan penalty)=31,744 Btuh

If the capacity increased because of the dual evaporator by just 2.48% then the new capacity would be:

31,744×1.0248=32,531 Btuh

The net capacity with 1000 cfm would be:

32,531−(1×365×3.413)=31285 Btuh

If the original EER was 17.1, then:

Total watts=30,000÷17.1=1754 watts.

Subtracting the difference for decreased fan penalty from 1,400 cfm to 1,000 cfm:

$$\begin{aligned}\text{Total watts (adjusted)} &= 1754 - (1.4 \times 365 - 1 \times 365) \\ &= 1754 - 146 \\ &= 1608\ \text{watts}\end{aligned}$$

The new EER would be:

31,285÷1608=19.5 EER

Therefore, there is an increase of almost 2½ EER points from the original EER of 17.1 which results in an overall increase in efficiency of 14.0%.

Also, with greater dehumidification, the thermostat set point can be raised and still be at the same comfort level. For example, referring to published ASHRAE Comfort Charts for Continuous Occupancies, if humidity drops from 70 to 50%, a thermostat setting of 75 degrees F., at the lower humidity level, would be just as comfortable as a setting of 73 degrees F., at the higher humidity level. This itself decreases the length of time the system is on by approximately 5 to 10% per degree higher temperature set point.

Finally, referring to the test data for a working model (dual or multi sectional evaporator) (FIG. 10) and comparing that to the data for a standard evaporator (FIG. 10*a*) both using the same condenser, it can be seen that at 82 degrees F. outdoor ambient temperature the capacity increased from 32,200 Btuh (at an EER of 12.53) for the standard evaporator (operating at a 45 degree F. evaporator temperature to 44,800 Btuh (at an EER of 16.08) (operating at a 55 degree evaporator temperature). At a 95 degree F. outdoor ambient temperature, the capacity increased from 31,500 Btuh (at an EER of 11.18 (45 degree F. standard evaporator) to 40,600 Btuh (at an EER of 13.51) (55 degree F. Evaporator temperature). This represents a documented increase in capacity of 39.1% and an efficiency increase of 28.3% at an 82 degree F. outdoor ambient temperature entering the condenser as well as a documented increase in capacity of 28.9% and an efficiency increase of 20.8% at a 95 degree F. outdoor ambient temperature entering the condenser.

Where subcooling to 70 degree F. is accomplished for a 2½ ton heat pump system that has the dual (or multi) sectional evaporator incorporated, the actual capacity increased from 31,200 Btuh to 32,600 Btuh while reducing the air volume by 400 CFM and maintaining the same evaporator temperature, for a net increase in efficiency. Both of these documented tests confirm the figures and calculations given previously.

Figure 1:
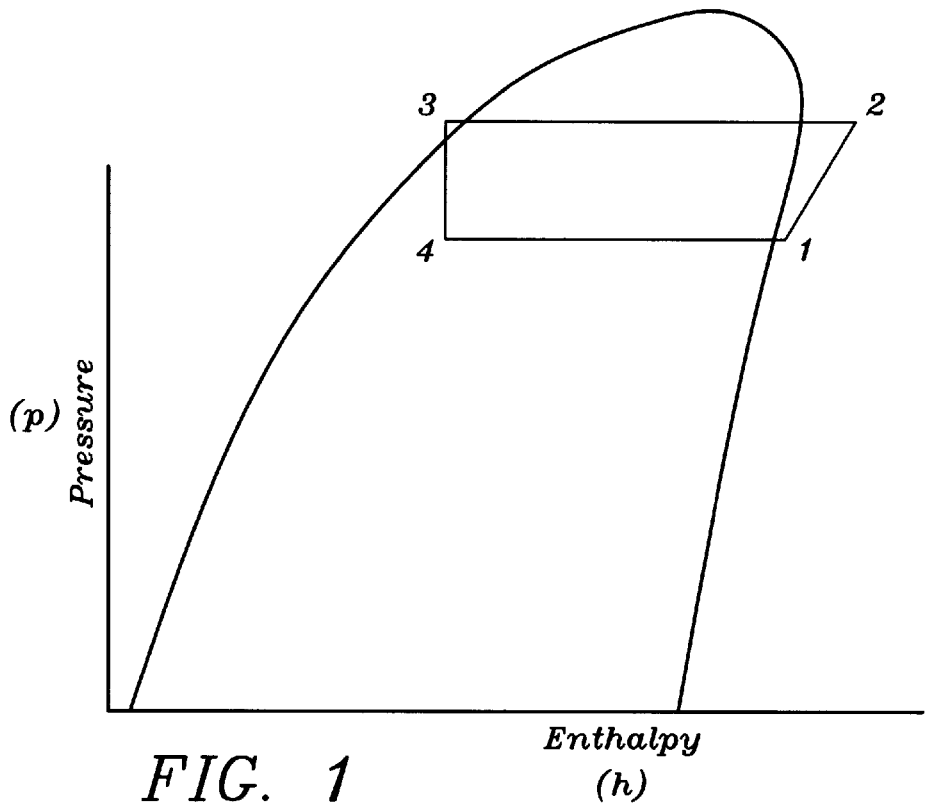
FIG. 1 is a pressure enthalpy diagram of the typical vapor compression cycle without the present invention.
Figure 1A:
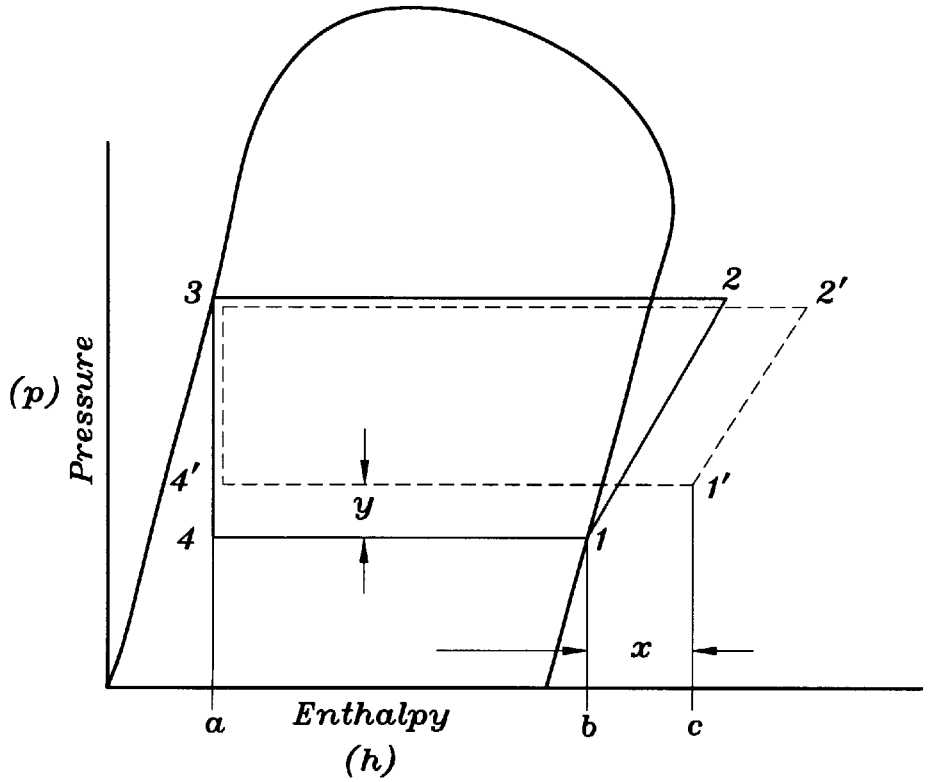
FIG. 1*a* is a pressure enthalpy diagram of the present invention where there is little or no sub-cooling overlaying a diagram of the typical vapor and compression cycle without the invention.
Figure 1B:
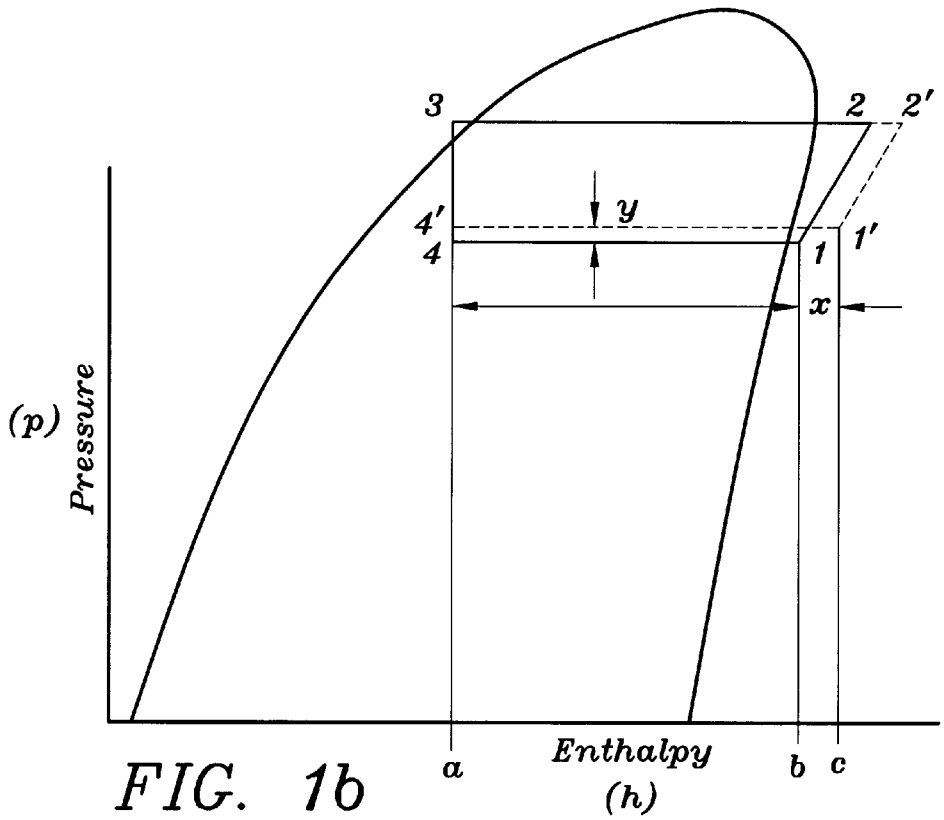
FIG. 1*b* is a pressure enthalpy diagram of the present invention where there is good subcooling overlaying a diagram of the typical vapor compression cycle without the invention.
Figure 2:
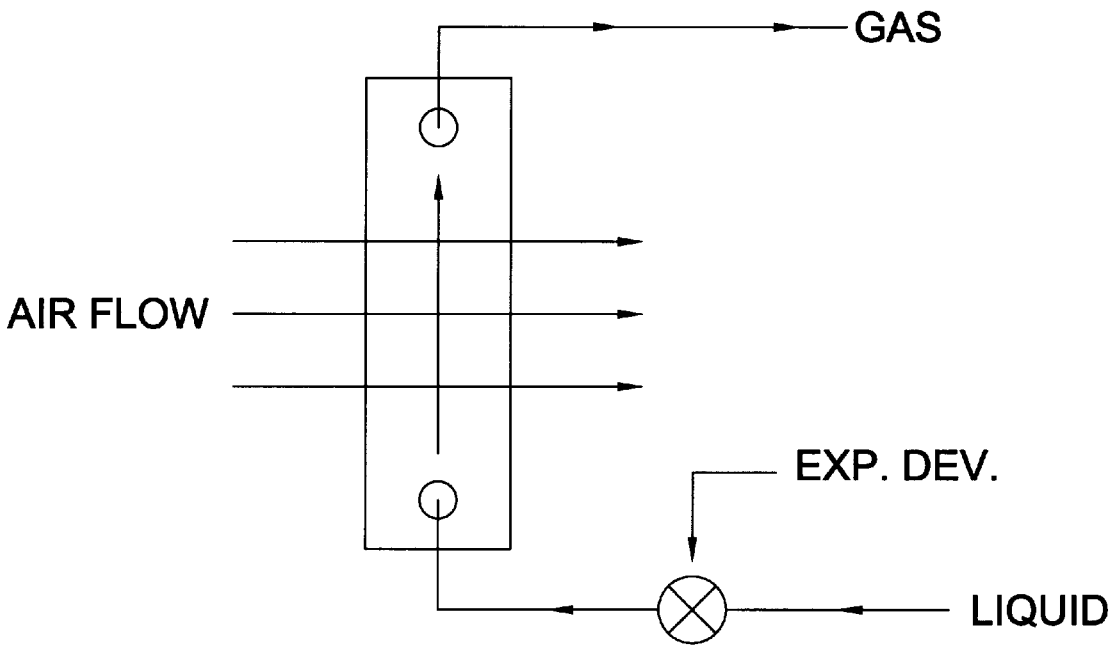
FIGS. 2 and 2*a* is an illustration of both the refrigerant and air flow in a standard evaporator showing the warmer and colder sections of the evaporator.
Figure 2A:
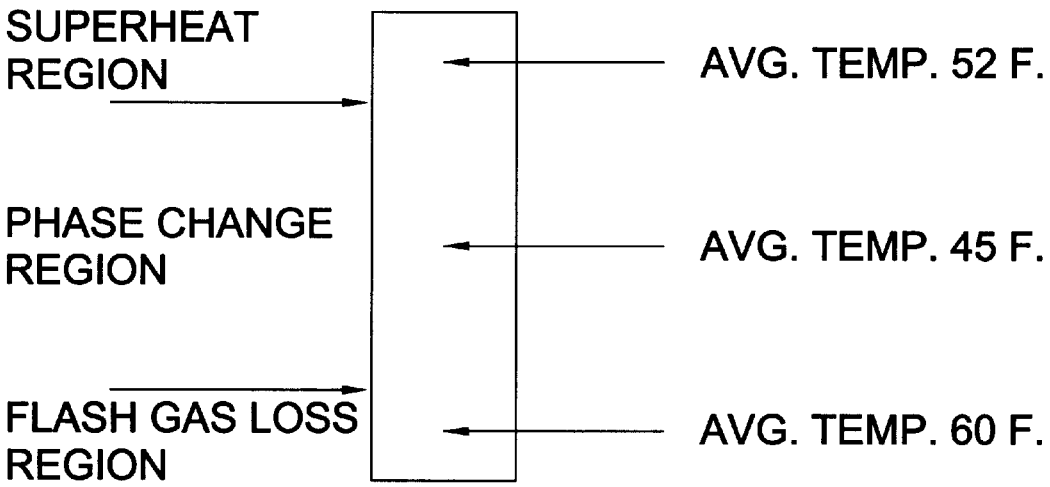

Now referring to the P-h diagram shown on FIG. 1*b*, the solid lined parallelogram represents the process of the typical cycle without the present invention. The intermittent lined parallelogram represents the cycle of the present invention superimposed upon the solid lined parallelogram wherein the increased superheating of the cycle of the present invention is represented with the letter x and the increase evaporator temperature which results in increased mass flow of the present invention is represented by the letter y. Adding 10 to 15 degrees F. of superheating increases the refrigeration capacity by 2 to 3 Btu per pound of circulated refrigerant. This would be a 3 to 5% increase in total capacity at no additional power consumption. Coupled with an increase in mass flow due to higher evaporator temperature, the overall increase in capacity would be as much as 25 to 30%, which would translate into an increase in 2 to 2½ EER points depending on original equipment and conditions.

The heat transfer to the refrigerant in the present invention is represented by area a-3-2'-c-a and the heat transferred from the refrigerant is represented by area a-4'-1'-c-a. Therefore, the area representing the difference between the two areas of heat transfer with the present invention is the work. On the other hand, the heat transfer without the present invention to refrigerant is the area a-3-2-b-a and the heat transferred from the refrigerant without the present invention is the area represented by a-4-1-b-a. Therefore, the area representing the difference between the two areas of heat transfer is the work without the present invention. Therefore, FIG. 1*b* illustrates that with the present invention more heat is transferred from the refrigerant as a result of the increased mass flow of the refrigerant as indicated by y than without the dual evaporator system (10). Moreover, increased superheating as indicated by x may be obtained with less work as a result of the secondary pass of refrigerant.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A sectional evaporator system having at least four sections for vaporizing a refrigerant passing through a thermal transfer cycle, said sectional evaporator system to be placed in an air stream having a width generated by an air supply, and said sectional evaporator system comprising in combination: first, second, third, fourth evaporator sections positioned in the air stream such that the first evaporator section is positioned edge-to-edge with the fourth evaporator section, both of which are positioned across the width of the air stream upstream of the second evaporator section, the second evaporator section is upstream of the third evaporator section, where all the sections being in sequential fluid communication with each other, such that the refrigerant passes first through the first evaporator section, then secondly through the second evaporator section, then thirdly through the third evaporator section, and then fourthly through the fourth evaporator section, thereby allowing sequential flow through the evaporator system, and thereby more fully approaching a true thermal counterflow heat exchange evaporator system.

* * * * *